United States Patent [19]

Franzer et al.

[11] 4,133,720

[45] Jan. 9, 1979

[54] SUPPORT APPARATUS FOR A BATTERY OF UNDERJET COKE OVENS

[75] Inventors: Wolfgang Franzer, Bochum-Wattenscheid; Hans J. Adamus, Essen, both of Fed. Rep. of Germany

[73] Assignee: Dr. C. Otto & Comp. G.m.b.H., Bochum, Fed. Rep. of Germany

[21] Appl. No.: 837,347

[22] Filed: Sep. 28, 1977

[30] Foreign Application Priority Data

Oct. 22, 1976 [DE] Fed. Rep. of Germany ..... 2647743

[51] Int. Cl.[2] ..... C10B 1/06; C10B 1/00; E04B 1/60

[52] U.S. Cl. ..... 202/223; 52/167; 202/139; 202/145; 202/222; 202/224; 110/193; 110/336

[58] Field of Search ..... 202/139, 145, 222, 223, 202/224; 52/167; 110/1 R, 1 A, 1 C

[56] References Cited

U.S. PATENT DOCUMENTS

| | | | |
|---|---|---|---|
| 1,193,068 | 8/1916 | Roberts | 202/223 X |
| 1,651,411 | 12/1927 | Porter | 52/167 |
| 2,001,169 | 5/1935 | Wallace | 52/167 |
| 2,208,072 | 7/1940 | Ropp | 52/167 |
| 2,690,074 | 9/1954 | Jones | 52/167 |
| 3,192,129 | 6/1965 | Becker | 202/223 X |
| 3,283,515 | 11/1966 | Pottorf | 52/167 UX |
| 3,510,999 | 5/1970 | Hubacher et al. | 52/167 X |
| 3,730,463 | 5/1973 | Richard | 52/167 X |
| 3,794,277 | 2/1974 | Smedley et al. | 52/167 X |
| 4,014,750 | 3/1977 | Franzer | 202/223 X |

*Primary Examiner*—Barry S. Richman

*Attorney, Agent, or Firm*—Thomas H. Murray; Clifford A. Poff

[57] ABSTRACT

Studs projecting downwardly from the decking carrying a battery of underjet coke ovens, all received in recesses in support walls which extend only in a parallel direction to the heating walls for the over chambers. Dampers are provided between the studs and the vertical surfaces of the recesses in the support walls for absorbing forces such as those developed during earthquakes which act parallel to the heating walls of the coking chambers. Strip members project downwardly from the decking along the sides of the support walls. Dampers are interposed between the strip members and support walls to absorb forces acting in a direction normal to the longitudinal heating walls of the coking chambers. The decking includes individual decking portions with adjoining boundary surfaces having interlocking projections.

2 Claims, 5 Drawing Figures

SUPPORT APPARATUS FOR A BATTERY OF UNDERJET COKE OVENS

BACKGROUND OF THE INVENTION

This invention relates to apparatus for supporting the battery decking of underjet coke ovens by means of support walls having reinforcement members bonded into a foundation slab while slip plates form sliding joints between the battery decking and the support walls which additionally include recesses receiving downwardly-extending studs from the battery decking along the center line of the battery. More particularly, the present invention relates to such support apparatus wherein dampers are provided between the studs and the vertical surfaces of the recesses in the support walls and additional dampers are provided between the support walls and strip members extending downwardly from the underside of the battery decking along the sides of the support walls.

In U.S. Pat. No. 4,014,750, assigned to the same Assignee as this invention, there is disclosed a support apparatus for a battery of coke ovens wherein the battery decking of underjet coke ovens rests on slip plates that are, in turn, supported on the top surfaces of walls which extend parallel to the longitudinal orientation of the coke oven chambers. The support walls are made from reinforced concrete with the reinforcement members bonded into a foundation slab on which the battery decking is supported. Downwardly-extending studs are provided on the battery decking along the center line of the coke oven battery. These studs are adapted to engage in openings in the individual support walls.

Such a support for the battery decking offers the important advantage of substantially reducing the amount of reinforced material required to form the support walls. The use of the studs projecting from the undersurface of the decking allows for the absorption of horizontal forces which act on the battery decking when the coke ovens are pushed. This support arrangement provides additional advantages in its construction. Such a support arrangement is in contrast to the conventional construction wherein the battery decking was supported by means of piles installed in rows extending parallel to the axis of the oven chamber. The piles are connected to the battery decking by strong beams.

The support means for the battery decking which is the subject matter of the above-identified patent is protected pursuant to the object of the present invention against the effects of earthquake shocks by employing suitably installed dampers. The invention is based on the realization that it is particularly suitable to install dampers in a relatively simple manner to achieve the type of support provided for the battery decking described in the aforementioned patent.

The idea of providing a foundation which is to be earthquake-proof has already been described for coke oven batteries having horizontal oven chambers. In the region of the middle longitudinal axis and the space between the foundation slab and support slab there were provided reinforced concrete strips anchored in such slabs while engaging one another. Resilient elements are disposed between the slabs to act in a longitudinal and transverse direction. Hydraulic or pneumatic devices comprising inter alia piston and cylinder assemblies are described as suitable forms for the resilient elements. These elements may further include buffers of natural or synthetic materials or steel springs, such as torsion springs or plate springs stacked as a unit with the springs oriented in pairs against one another. In a coke oven battery comprising a large number of oven chambers, only a single resilient element intended to act along the longitudinal direction of the battery, is provided in the middle thereof between the foundation slab and the support slag and only one unit of resilient elements is provided near each battery end for absorbing forces which act in a transverse direction.

The elements which are employed to act as security against earthquake shocks must absorb forces, that are readily determined by calculation, which cannot be absorbed by resilient components installed at so few points of the battery. It is assumed that a so-called "horizontal factor" of about 0.2 must be maintained. Factors of this order are specified for buildings in countries subject to earthquake risk. The horizontal factor is known to refer to the percentage of vertical forces which must be absorbed at the center of gravity of the building in the form of a horizontal force. A factor of 0.35 is necesssary for areas which are subjected to particularly severe earthquakes. It can be readily calculated that the installation of resilient elements at so few points is completely inadequate for an entire coke oven battery.

SUMMARY OF THE INVENTION

It is an object of the present invention to provide dampers arranged to act parallel to the longitudinal direction of coke oven chambers by disposing such dampers between each of a plurality of studs disposed on the underside of the battery decking and vertical surfaces defining openings in the support walls for the studs.

It is still another object of the present invention to provide in addition to dampers disposed to act parallel to the longitudinal direction of the oven chambers, other dampers disposed between the top portion of the two longitudinal sides of at least part of the support walls and parallel strips which project from the underside of the battery decking. These dampers are provided to act against earthquake forces parallel to the longitudinal direction of the battery.

More specifically, according to the present invention, there is provided apparatus for supporting the battery decking for an underjet coke oven battery which includes coking chambers having longitudinal heating walls with flues therein receiving gaseous combustion media, the apparatus including the combination of a foundation slab, support walls extending along only in a parallel direction to the coke oven chambers for supporting the battery decking thereabove, the support walls including reinforcement members therein bonded to the foundation slab, the top surfaces of the support walls include recesses along the center line of the underjet coke oven battery, sliding joints including slip plates between the support walls and battery decking, studs extending downwardly from the battery decking into the recesses in the support walls along the center line of the underjet coke oven battery, dampers between the studs and the vertical surfaces formed by the recesses in the support walls for acting parallel to the heating walls of the coking chambers, strip members extending downwardly from the underside of the battery decking along the sides of the support walls while spaced therefrom, and dampers between the strip members and the top portion of the two longitudinal sides of at least one of the support walls for acting in a direction normal to the longitudinal heating walls of the coking chambers.

In the preferred form of the present invention, the battery decking includes individual decking portions having lengths corresponding to a multiple of the center distance between the coking chambers, the boundary surfaces of the decking portions which extend parallel with the coking chambers having interlocking projections, the arrangement of the dampers between the strip members and the support walls being provided for each decking portion on at least one support wall.

It is known to subdivide battery decking into individual portions which have a length corresponding to a multiple of the center distance between the oven chambers. The individual portions of the battery decking are allowed to engage in an interlocking manner at the boundary surfaces situated parallel to the oven chambers. According to the present invention, the dampers which act in the longitudinal orientation of the coke oven battery are provided for each section at least on the top portion of one of the support walls which is provided in the middle of each decking portion.

According to a further aspect of the present invention, it is also possible to provide the aforementioned dampers at the top portions of each individual support wall.

These features and advantages of the present invention as well as others will be more fully understood when the following description is read in light of the accompanying drawings, in which.

Figure 1:
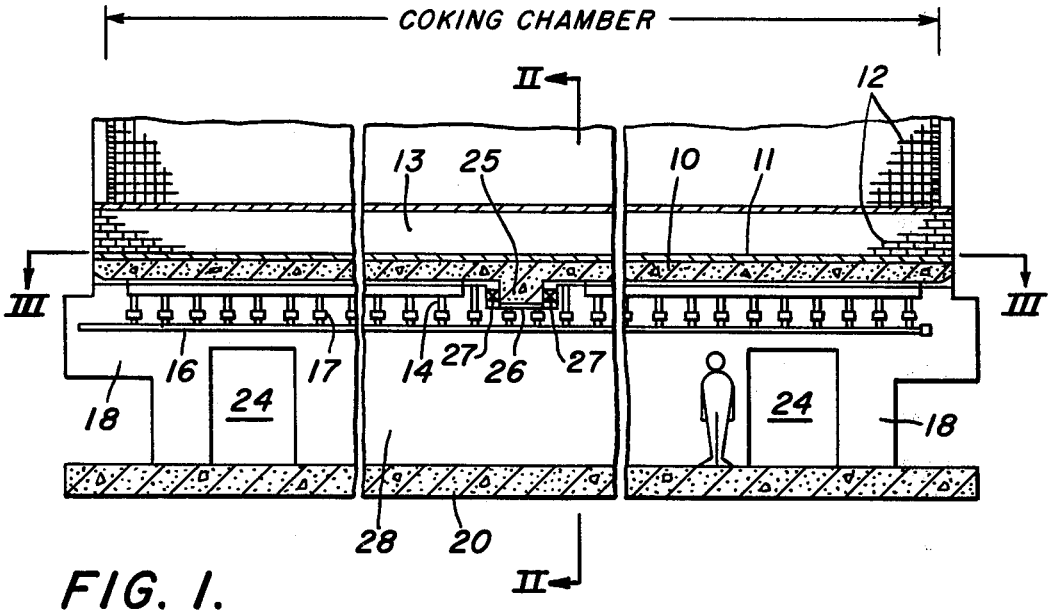
FIG. 1 is a vertical section, twice interrupted, taken parallel to the longitudinal axis of a coke oven chamber and a heating wall thereof and through the substructure of a battery of underjet coke ovens.
Figure 2:
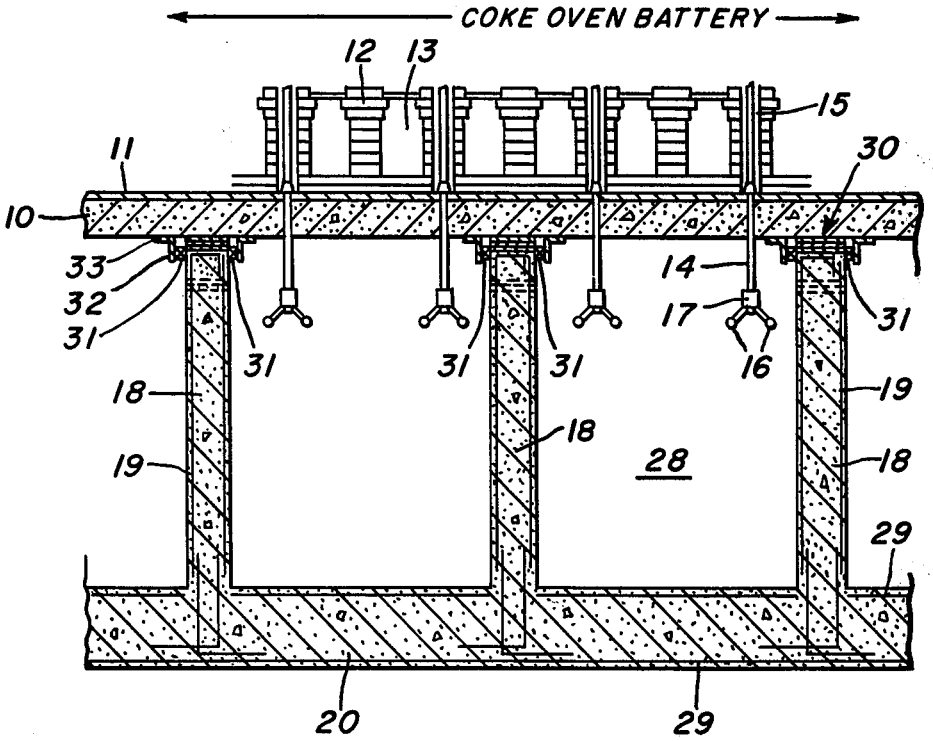
FIG. 2 is a vertical sectional view taken along line II—II of FIG. 1.
Figure 3:
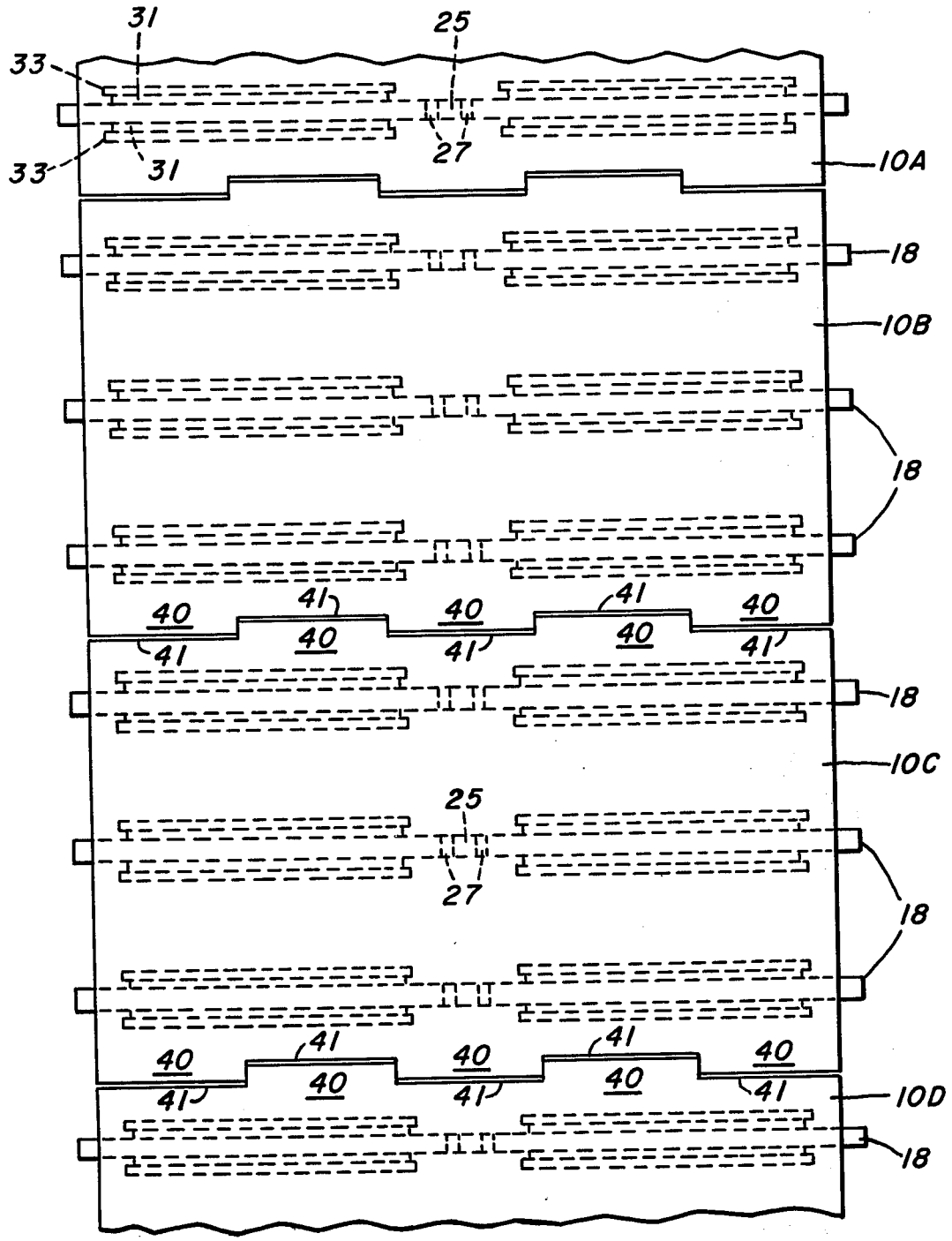
FIG. 3 is a horizontal sectional view taken through the battery decking along line III—III of FIG. 1.

As shown in FIGS. 1 and 2, a battery decking 10 carries a stratum of insulating concrete 11. Refractory brickwork 12 extends above the stratum of insulating concrete and contains sole ducts 13 which are connected by regulating elements to regenerators disposed above the ducts. In FIG. 1, the pusher side and the coke side of the oven chamber lie at opposite ends of the illustration so that the longitudinal axis of the coking chamber as well as the heating walls therefor extend along the plane of the illustration in FIG. 1. The longitudinal direction of the battery of coke ovens is illustrated in FIG. 2.

Vertical pipes 14 traverse the battery decking. These pipes extend at the top into the brick ducts 15 in the regenerator bulkheads and lead to the burners in the heating walls. The vertical pipes 14 are connected to horizontally-arranged distribution pipes 16 for rich gas in a cellar 28. Gas control nozzles 17 are disposed in the supply pipes and these nozzles can be adjusted from the cellar.

Figure 4:
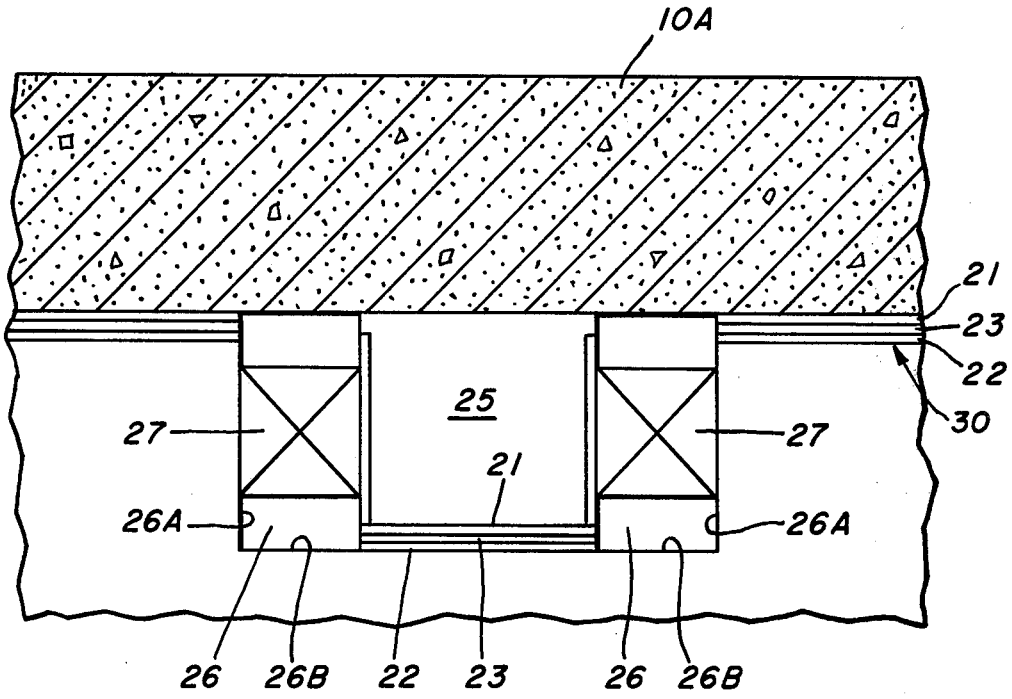
FIG. 4 is an enlarged view of the dampers and the relationship of parts thereof according to the present invention.

The battery decking is supported upon a foundation slab 20 by means of support walls 18 having reinforcement members 19 bonded into the foundation slab by means of dowels and with reinforcement members 29 embedded in the foundation slab 20. A sliding joint 30, as best shown in FIG. 4, permits the battery decking to slide upon the support walls. The sliding joint is provided between the top surface of the support walls and the battery decking 10. The sliding joint includes slip plates formed by a top plate 21, a bottom plate 22 and a layer of graphite paste 23 disposed between the plates 21 and 22. The support walls 18 are provided with openings 24 such that the height of the opening will accommodate workmen or other personnel.

The battery decking 10 is subdivided into individual deck portions 10A, 10B, 10C, etc. The length of each deck portion corresponds to a multiple of the center distance between adjacent coke oven chambers and preferably corresponds to six times the center distance between adjacent coke oven chambers. The deck portions 10A, 10B, 10C, etc. interlock with each other by means of projected portions 40 and recessed portions 41 forming a serrated boundary between the deck portions. In this way, the oven decking is capable of absorbing expansions which take place in the longitudinal orientation of the battery that occur during heating-up of the battery. The deck portions 10A, 10B, 10C, etc. rest on the support walls 18 by means of the slide plates 21 and 22 with graphite paste 23 therebetween.

As shown in FIG. 4, a stud 25 is provided on the underside of the deck portions 10A, 10B, 10C, etc. A stud 25 is located in each instance at the location of a support wall 18. Each stud engages a recess 26 in the top portion of a support wall 18. The recess 26 is defined by vertical side wall surfaces 26A and a horizontal bottom wall surface 26B. According to the present invention, dampers 27, shown in FIGS. 1 and 4, are provided between a stud 25 which projects from the underside of a deck portion and the side walls 26A of recess 26. The dampers 27 are operatively arranged to absorb shocks in the direction of the axis of an oven chamber, i.e., transversely to the longitudinal orientation of the coke oven battery. The dampers can be differently constructed and examples of such dampers include hydraulic or pneumatic devices including inter alia piston and cylinder assemblies as well as resilient elements including buffers of natural or synthetic materials or steel springs, such as torsion springs or units comprised of a stack of plate springs.

Figure 5:
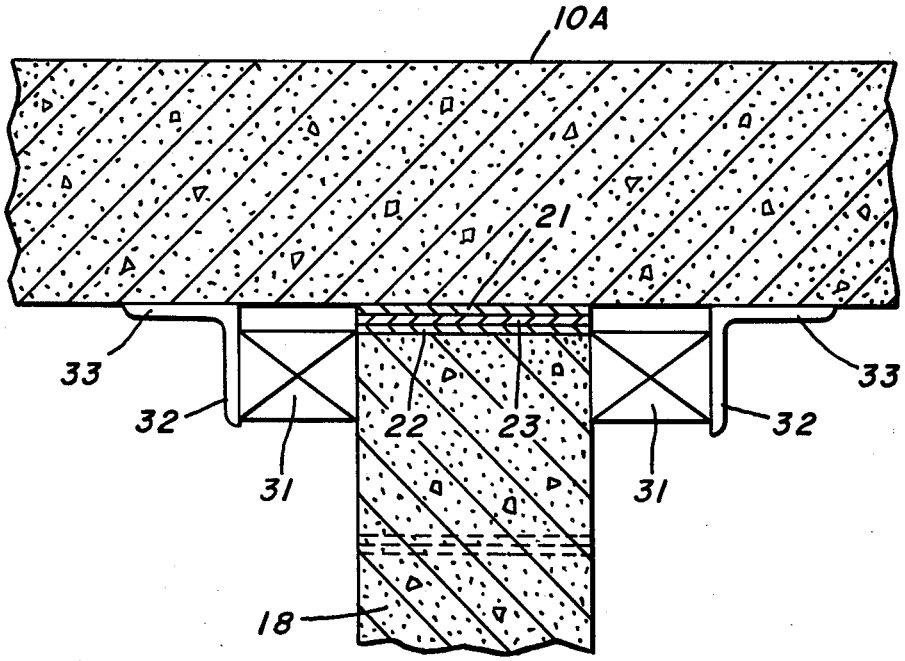
FIG. 5 is an enlarged sectional view of part of FIG. 2 showing the top part of a support wall with the dampers at the sides thereof.

Dampers 31 are provided to absorb shocks along the longitudinal orientation of the coke oven battery. One side of the dampers 31 bears against the top portion of the support walls 18 and the other side of the dampers bears on vertical members 32 of a strip constructed in the form of an angle iron with a horizontal member 33 mounted onto the underside of the relevant portion of the decking part. The vertical member 32 of the angle iron extends downwardly from the oven decking which is best shown in FIG. 5.

As described hereinbefore, it may be sufficient to provide the connection by means of the dampers 31 only on the top portion of one support wall 18 situated beneath an oven decking portion. In order to absorb or allow for a particularly powerful force, it is also possible to provide dampers on several support walls at the top portion of all support walls situated beneath a portion of the oven decking. However, it should be noted that the use of dampers 31 calls for the attachment of the brackets comprising members 32 and 33 onto the underside of the oven deck portions. These brackets can, however, only be provided on the support wall situated in the center of a decking portion when the structure is erected. The brackets required on the remaining support walls for the insertion of dampers can be attached only after the oven has been heated up and the concrete structure has expanded according to its service temperature.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Support apparatus for an underjet coke oven battery which includes coking chambers having longitudinal heating walls with flues therein receiving gaseous combustion media, said apparatus including the combination of:

battery decking carrying said underjet coke oven battery, a foundation slab for supporting said battery decking at a vertically-spaced relation thereabove, a plurality of support walls including reinforcement members therein bonded into said foundation slab to support said battery decking while forming a cellar, said cellar including gas distribution ducts for said gaseous combustion media, the top surfaces of said support walls including recesses along the center line of said underjet coke oven battery, sliding joints including slip plates between said support walls and said battery decking to permit relative movement therebetween due to thermal expansion, studs extending downwardly from the battery decking into said recesses in the support walls along the center line of the underjet coke oven battery to absorb horizontal forces imposed on said battery decking when pushing coke from said coking chambers, dampers below said battery decking engaged between said studs and the vertical surfaces of said recesses in the support walls for acting parallel to the heating walls of the coking chambers, strip members extending downwardly from the underside of said battery decking along the sides of said support walls while spaced therefrom, and dampers below said battery decking engaged between said strip members and the top portion of the two longitudinal sides of at least part of said support walls for acting in a direction normal to the longitudinal heating walls of said coking chambers.

2. The combination according to claim 1 wherein said battery decking includes individual decking portions having lengths corresponding to a multiple of the center distance between said coking chambers, the boundary surfaces of said decking portions which extend parallel with the coking chambers having interlocking projections, the arrangement of said dampers between said strip members and said support walls being provided for at least one support wall of each decking portion.

* * * * *